US006517200B1

(12) United States Patent
Ramaswamy et al.

(10) Patent No.: US 6,517,200 B1
(45) Date of Patent: Feb. 11, 2003

(54) TRANSPORT BUFFER HAVING FORCE LIMITING DRIVE MEANS AND METHOD

(75) Inventors: Rajan Ramaswamy, San Diego, CA (US); David B. Petch, La Jolla, CA (US)

(73) Assignee: Phogenix Imaging, LLC, San Diego, CA (US)

( * ) Notice: Subject to any disclaimer, the term of this patent is extended or adjusted under 35 U.S.C. 154(b) by 0 days.

(21) Appl. No.: 10/034,183

(22) Filed: Dec. 28, 2001

(51) Int. Cl.[7] ..... B41J 2/01
(52) U.S. Cl. ..... 347/104
(58) Field of Search ..... 347/104, 101, 347/1; 226/10; 271/10.13, 10.11, 10.09, 10.01, 8.1; 346/134; 399/361; 400/578

(56) References Cited

U.S. PATENT DOCUMENTS 6,206,364 B1 * 3/2001 Brinkman et al.

* cited by examiner

*Primary Examiner*—Raquel Yvette Gordon
(74) *Attorney, Agent, or Firm*—Stephen B. Salai, Esq.; Roger Aceto, Esq.; Harter, Secrest & Emery LLP

(57) ABSTRACT

A buffer for transporting a flexible work piece such as a printed sheet between a first and a second workstation having different operational speeds. The buffer has drive rollers arranged along a path of travel from the outlet of the first station to the inlet of the second for moving the work piece through the buffer at a constant speed that may be different than the operational speeds of the workstations. A slip clutch limits the torque applied by the drive rollers should the constant speed of the buffer be greater than the speed at which the sheet is moving through the first work station and a one-way clutch allows the drive rollers to overrun a drive shaft to permit the sheet to move into and out of the buffer at a speed greater than the constant speed.

19 Claims, 3 Drawing Sheets

TRANSPORT BUFFER HAVING FORCE LIMITING DRIVE MEANS AND METHOD

TECHNICAL FIELD

The present invention relates to a photofinishing system wherein images of a wide variety of types such as photographic images from an inkjet printer are laminated in a subsequent operation. More particularly the present invention relates to such a system having a buffer between the inkjet printer and the laminator for transporting the printed images from the inkjet printer to a laminator.

BACKGROUND OF THE INVENTION

In photofinishing operations it is conventional to develop and print photographs on roll stock photographic paper having a width that generally accommodates one size of print. After printing out a roll of photos on a strip of the roll stock, the strip is cut to provide the individual prints. Dedicating a given size of roll stock to the production of a given size photo is less flexible for fulfilling print orders and slows throughput. It requires the photofinishing operation either to have multiple machines, each dedicated to a given size of photo or it places a burden on the operator to change the print media from one size to another after completing orders.

Advancements in photofinishing allow for the production of photographs by ink jet printers, laser printers and other photofinishing printers including silver-halide systems that receive digital input and employ conventional wet chemistry output. Moreover the use of computers in connection with these advancements allows for further improvement. For example, it is not necessary to use roll stock having the width of a desired finished photo. A photofinishing printer now can generate photos of various sizes on a single sheet of print media. Also the images can be manipulated to nest various image sizes on a single larger sheet. Accordingly, a sheet or roll stock of a single width can be used to generate prints of various sizes for a single customer order.

Currently, the photofinishing printer of choice is an inkjet printer. Inkjet printing comprises a scan and print technology involving an intermittent indexing of the print medium. In this respect the print medium such as photographic paper is fed to the printer and is held stationary by the printer while an inkjet print head makes a printing scan across the paper. The paper then is indexed for a second scan of the print head. In this fashion a plurality of scans will generate the photographic image.

Inkjet prints historically have been subject to problems such as durability and fading because of limitations put on ink systems used in inkjet printers. For example the printed image can be eroded by abrasion. Both the durability and fading problems are solved by the application of a protective laminate to the image after printing. A protective laminate is applied by passing the print continuously through a laminator in order to apply a protective transparent layer to the surface of the print. While lamination provides an acceptable solution to image problems associated with inkjet prints, the start and stop indexing motion inherent in inkjet printing conflicts with the operation of a laminator, which typically operates with continuous motion.

Accordingly, to applicant's knowledge and for the reasons noted above, an inkjet printing system and a laminator system have not been linked in a continuous sequential operation and heretofore a sheet comprising the print output of an inkjet printer was not directly fed into a laminator.

Instead the printed sheets were simply removed from the printer and accumulated for later feeding one at a time to a laminating device.

Feeding the printed sheet output of an inkjet printer to a laminator presents several problems. For example, the inkjet printer used in photofinishing operations typically can produce printed sheets in a variety of lengths. Thus a transport mechanism for feeding the printer output to the laminator must be able to accommodate each of the various lengths of prints that are output by the printer. Also, in order to minimize space, it is preferred that the transport mechanism receive a leading portion of the printed sheet from the printer while a trailing portion is still in the grip of the printer. Thus a leading edge of the printed sheet should enter the transport mechanism before the sheet is completely printed. However, when the leading edge of the partially printed sheet is in the grip of the transport mechanism, the transport mechanism must not interfere with the start/stop indexing motion of the portion of the sheet still in the printer. Any resistance to this motion or any attempt of the transport mechanism to tug on the sheet prior to the completion of the printing operation will likely degrade the print quality.

After the printing operation is completed, the printer will eject the printed sheet at a continuous speed that generally is faster than the start/stop indexing motion of the printing operation. The transport mechanism must accommodate this faster movement of the sheet and then deliver the sheet to the laminator. As the transport mechanism moves the leading edge of the sheet to the laminator, the laminator will grip the leading edge and tend to draw the sheet from the transport mechanism. To prevent damage to the sheet or the printed image, the transport mechanism must offer no resistance to the drawing out of the sheet.

Thus a transport mechanism for disposition between an inkjet printer and a laminator must have several attributes. It should be able to accommodate various sizes of prints up to the longest produced by the printer. It must not interfere with printing by resisting the start/stop indexing motion of the inkjet printing operation or attempt to tug on a partly printed sheet. It also should allow rapid deployment of the sheet from the printer at the end of the printing operation, convey the sheet to the laminator and not resist the drawing of the sheet from the buffer by the laminator.

OBJECTS OF THE INVENTION

Accordingly, it is an object of the present invention to provide a transport mechanism for handing off a work piece from one device to another wherein the devices have different processing speeds.

Another object of the present invention is to provide a transport mechanism between an ink jet printer and a laminating device for delivering a printed sheet from the printer to the laminator wherein the laminator has a faster processing speed than the printer.

A further object of the present invention is to provide a transport mechanism for receiving a printed sheet output of an inkjet printer and delivering the printed output directly to a laminator wherein the transport mechanism accommodates two processing speeds of the printer and a single operating speed of the laminator.

Yet another object of the invention is to provide a method for delivering a printed sheet produced at a first processing speed by an inkjet printer to a laminator operating at a different processing speed.

SUMMARY OF THE INVENTION

In the present invention, a transport mechanism is provided that includes a buffer disposed to receive a printed page output of an inkjet printer and deliver the printed page or sheet to a coater/laminator that applies a protective lamination to the printed surface. The sheet moves through the printer at a first speed during the printing operation, the first speed being the average of a start/stop movement required for inkjet printing namely a peak speed during the indexing of the paper and a stoppage or pause for printing. The printed output then ejects from the printer at a speed that is faster than the first (average) speed. Subsequently, the printed sheet moves through the laminator at yet another speed usually faster than the average first speed.

The buffer, disposed between the printer and laminator, includes a track that defines a path of travel long enough to accommodate the longest sheet produced by the printer. The buffer receives the printer output in a manner that accommodates the two speeds of the printer without interfering with the operation of the printer. The buffer then delivers the printer output to the laminator in a manner that accommodates the operating speed of the laminator.

The buffer includes driven rollers arranged along the track for moving the printed sheet through the buffer preferably at a constant speed that is between the eject speed of the printer and the operating speed of the laminator. Each of the rollers includes a one way clutch that allows the rollers to overrun a drive shaft in response either to the ejection of a printed sheet from the printer or to the laminator tugging on a sheet leaving the buffer. In addition, the driven rollers include a slip clutch between a drive motor and the drive shaft that limits the drive force exerted by the rollers on a printed sheet. This prevents the driven rollers from tugging so hard on a sheet that is still within the grip of the inkjet printer at a time prior to ejection that the image quality is reduced.

Accordingly, the present invention may be characterized in one aspect thereof by a transport buffer for transporting a flexible sheet along a path of travel between an outlet of a first workstation and an inlet of a second workstation, the first workstation intermittently delivering the flexible sheet to the buffer at a first peak speed and a first average speed in a first mode of operation (such as an inkjet printing operation) and continuously delivering the flexible sheet to the buffer at a second speed in a second mode of operation (such as when the printed sheet is ejected from the printer), and the second workstation taking up the flexible sheet at a third speed, the buffer comprising:

a) a drive roller arranged along the path of travel for engaging and moving the flexible sheet through the buffer, the drive roller being operatively connected to a motor for driving the rollers at a substantially constant drive speed;

b) a first clutch having a predetermined torque limit allowing slippage of the drive roller when the constant drive speed is greater than the speed at which the flexible sheet is moving from the first workstation and into the buffer; and c) a second clutch allowing the drive roller to rotate at a speed faster than the constant drive speed to permit movement of the flexible sheet into the buffer from the first workstation at a speed greater than the constant drive speed.

In another aspect, the present invention may be characterized by a method of transporting a flexible sheet moving from a first workstation operating at a first average speed and a first peak speed faster than the average speed in a first mode of operation and at a second speed in a second mode of operation, to a second work station operating at a third speed greater than the first average speed comprising;

a) engaging the sheet leaving the first workstation with a rotating driver for moving the sheet along a path of travel at a constant speed from the first workstation to the second workstation;

b) limiting the torque applied by the rotating driver for moving the sheet in the buffer when the constant speed is greater than the speed at which the sheet is moving from the first work station; and c) freeing the rotating driver to rotate at a speed greater than the constant speed to permit movement of the sheet into the buffer at a speed greater than the constant speed.

DETAILED DESCRIPTION OF THE INVENTION

Figure 1:
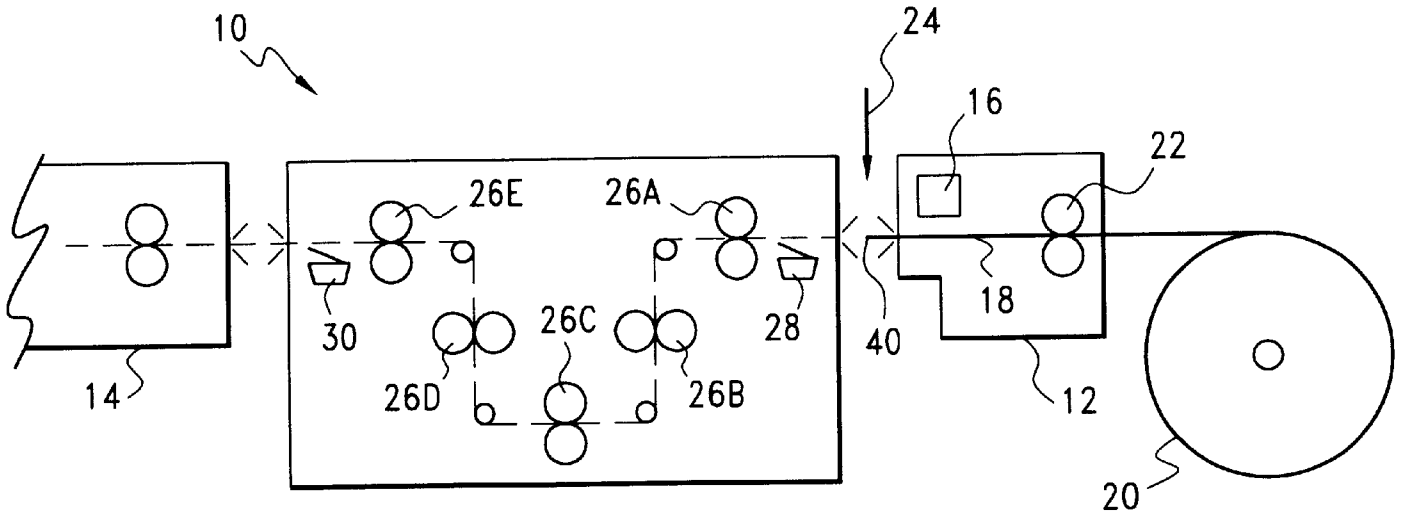
FIGS. 1–6 are schematic views showing steps in the operation of the buffer of the present invention.

Referring to the drawings FIG. 1 shows a schematic representation of the buffer of the present invention generally indicated at 10. The buffer is disposed between a photofinishing inkjet printer 12 and a coater/laminator 14 located downstream of the printer. The inkjet printer is conventional and need not be described in detail except to say that it includes a print head 16 containing a plurality of nozzles (not shown).

The print head is mounted for movements back and forth across a photographic paper 18 (in a direction normal to the plane of the figure) wherein a portion of a photographic image is printed with each scan or pass of the print head. While the paper can be fed in sheets to the printer, it is preferred that the paper supply be a roll 20 so the supply is continuous. Drive rollers 22 within the printer feed the paper to the print head and step the paper forward for each printing pass of the print head. Thus the movement of the rollers is intermittent in that the paper first is indexed or stepped forward at a peak speed, then movement is stopped and the paper is held for a printing pass of the print head. After the pass of the print head is complete, the paper is indexed forward again and stopped for the next pass. In this fashion a plurality of passes or scans across the paper will generate the photographic image and the speed through the printer in a first mode of operation is an average taking into consideration the peak speed or index time and the pause time for each scan. Each indexing of the paper is a precise movement that is adversely affected by any external resistance to the movement of the paper or by tugging on the paper. The force that can be applied to the paper without degrading quality depends on the particular printer. In one embodiment of this invention, the printer can sustain a tugging force of just under 100 grams without degrading the image.

After completion of a printing operation, the printed portion is ejected from the printer by the rollers 22 in a second mode of operation comprising a continuous movement of the printed portion. The printed portion then is cut from the continuous supply by a knife 24. Accordingly, for purposes of the present invention it should be appreciated that the start/stop movement during the printing operation in a first mode of operation is at an average first speed whereas the ejection of the completed print occurs in a second mode of operation at a second speed that is faster than average speed of the printing operation.

In some printers of the type with which the present invention may be employed, the printer may occasionally reverse the motion of the paper during printing. This most commonly occurs during servicing of the printer to reduce waste.

From the printer, the cut off printed portion referred to hereafter as a "segment" enters buffer 10. The buffer has an internal track that defines a path of travel (indicated by dotted line) for delivering the segment to the downstream laminator 14. The laminator also is conventional and need not be described in detail. It is sufficient to say that the laminator receives the segment and applies a protective laminate (not shown) to the printed surface of the segment as the segment moves through the laminator. Preferably, the laminator 14 operates at a third speed somewhere between the average first speed of the printer and the ejection or second speed of the printer. More generally, the laminator operates at a speed faster than the first average speed. Accordingly, one function of the buffer 10 is to permit the hand off of the segment between the two devices operating at different speeds.

To accommodate the hand off, the buffer 10 of the present invention defines a path of travel, as shown in dotted line in the Figures, that is preferably at least as long as the longest segment produced by the printer. Disposed along this path of travel is a series of drive rollers 26. These rollers nip against the segment and are driven so as to move the segment through the buffer preferably at a constant speed that most preferably is faster than the average first speed of the printer and slower than the ejection speed of the printer. Contact switches 28, 30 at the inlet and exit respectively of the buffer operate to start and stop the action of the rollers 26.

Figure 7:
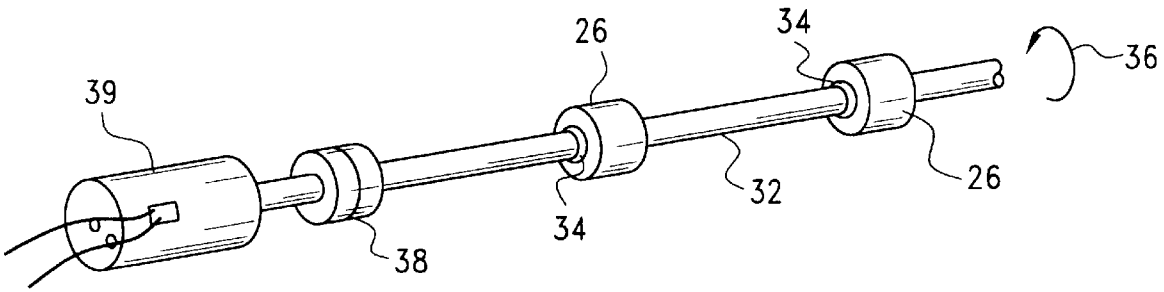
FIG. 7 is a perspective view showing a driven roller mechanism as used in the buffer.

A typical drive roller mechanism is shown in FIG. 7. As shown in FIG. 7, the drive roller mechanism includes one or more drive rollers 26 carried by a drive shaft 32. The drive shaft, in turn, is connected to a drive motor 39. A one-way clutch 34 transmits force from the drive shaft to each roller for driving the roller in the direction indicated by arrow 36. The one-way clutch also permits the roller to overrun the shaft so the clutch frees the roller to rotate faster than the drive shaft in the direction of arrow 36. A slip clutch 38 is disposed between the drive shaft 32 and the motor 39. The slip clutch limits the torque or drive force exerted by the roller on the segment in the direction of arrow 36 for purposes set out hereinbelow. Preferably, the force limit of the slip clutch is set somewhere below the maximum force that can be tolerated by the printer without degrading the image, to provide a safety factor. When used with the printer described above, that can sustain just under 100 grams of force without degrading print quality, a slip clutch limit of about 60 grams can be used.

Operation will be described beginning with reference to FIG. 1 wherein the photographic paper is being fed through the printer. As an image is printed, rollers 22 intermittently index the paper by the print head 16. At each pause in the indexing cycle, the rollers hold the paper and the print head scans across the paper to print a portion of the image. As the start/stop printing movement continues, the leading edge 40 of the paper enters the buffer 10. Eventually the paper progresses into the buffer and engages the contact switch 28. This starts the operation of the drive rollers 26 within the buffer. The drive shaft operating through the slip clutch 38 and one-way clutch 34 drives these rollers at a constant speed that, as noted above, is faster than the printing speed of the printer but slower than the eject speed.

Figure 2:
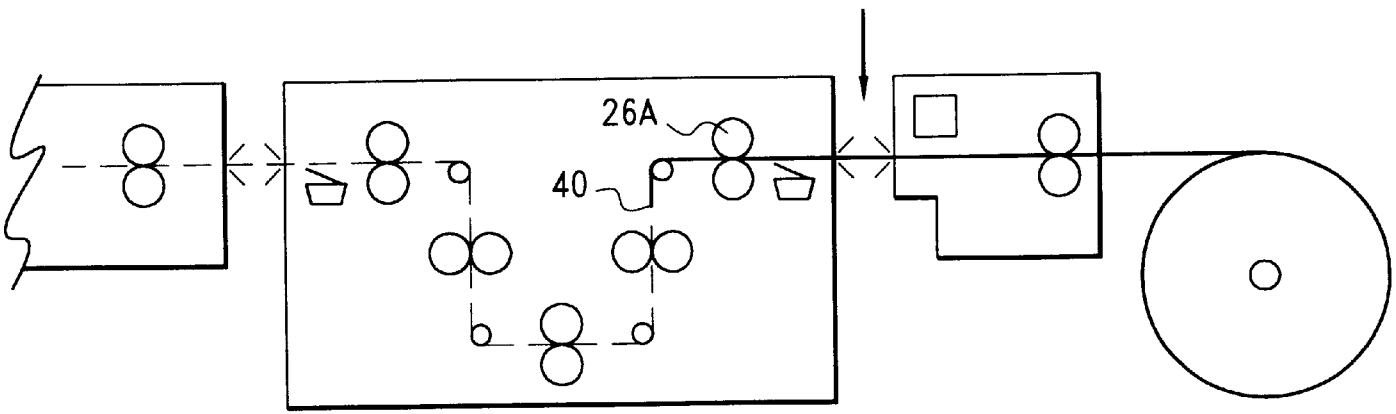

When the leading edge 40 of the paper enters through the nip between the first set of buffer drive rollers 26A, as shown in FIG. 2, these rollers will begin to tug on the paper. This invention limits the tugging force to a level that will not tend to disrupt the printing operation and degrade the print quality. The slip clutch or torque limiter 38 that couples the drive motor 39 to the drive shaft 32 and the one-way clutch 34 between the drive shaft and the rollers are set up to prevent the rollers 26A from tugging on the paper while movement of the paper is paused. This is done by setting the slip clutch 38 so as to limit the drive force exerted on the paper by the rollers 26 to a level below that which can cause an adverse effect on print quality.

As the paper is indexed forward for the next printing scan of the print head, the engagement of the paper in the nip between rollers 26A must not resist the sudden and rapid forward stepping of the paper at a peak speed. Such resistance also will adversely affect print quality. To prevent such resistance, the one-way clutch 34 between the drive shaft 32 and the roller allows the rollers to overrun the shaft. In this fashion the paper, as it is stepped forward, will exert sufficient force on the rollers 26A to overrun the shaft so there is little or no resistance to such forward movement.

Figure 3:
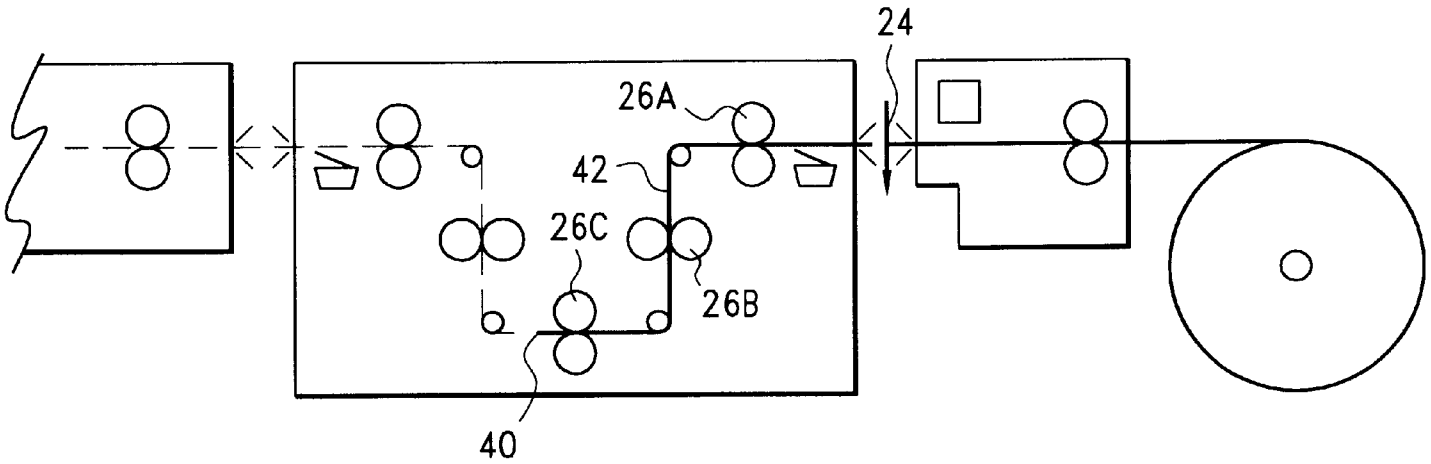
Figure 4:
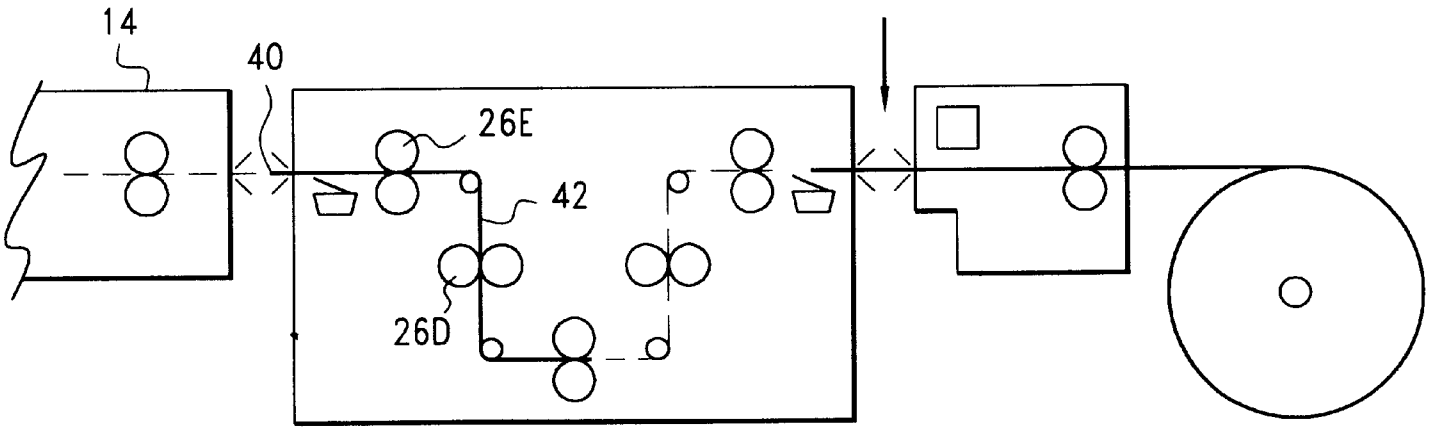

After the printing operation is complete, the printer ejects the printed portion of the paper. If the paper is ejected at a speed faster than can be accommodated by the rollers 26, the slip clutch allows theses rollers to overrun the shaft so the paper is moved rapidly into the buffer. After the printed portion is ejected, movement stops so the knife 24 can cut a printed segment 42 from the paper in the printer (FIG. 3). The buffer drive motor 39 is turned off while the paper is held for cutting. After the segment 42 is cut from the paper supply, the drive motor 39 is turned on to drive rollers 26 of the buffer to move the segment through the buffer at a constant speed and deliver it to the downstream laminator 14 (FIG. 4). Meanwhile, the printer starts another printing operation.

Figure 5:
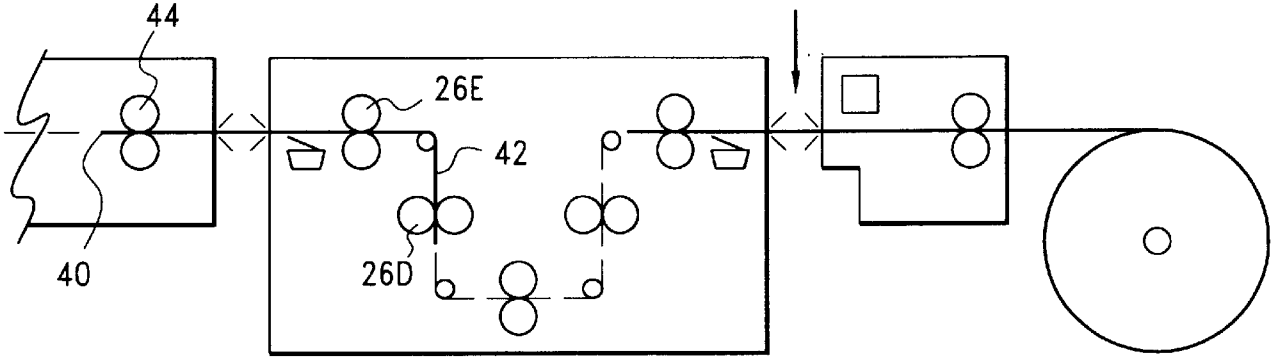

FIG. 5 shows the printed segment 42 entering the laminator. The leading edge 40 of the segment enters the nip between laminator driven rollers 44 so the segment is pulled into the laminator. At this point, a trailing portion of the segment may still be in the grip of drive rollers 26 in the buffer. Accordingly, as the segment 42 is pulled into the laminator, the one-way clutches 34 associated with each roller 26 allows the segment to be pulled into the laminator at a speed faster than the transport speed through the buffer by allowing the segment to overrun the speed of shaft 32. Conversely, if the laminator operates slower than the buffer, the slip clutch 38 will prevent the buffer rollers from forcing the segment into the laminator.

Figure 6:
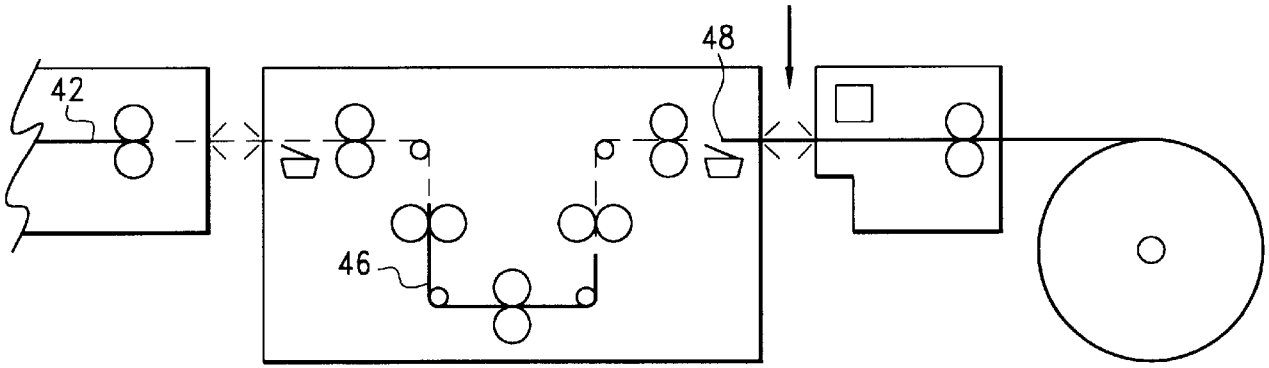

FIG. 6 shows the segment 42 completely within the laminator as a subsequent and shorter segment 46 is being transported through the buffer and the leading edge 48 of yet another printed portion is entering the buffer.

Thus it should be appreciated that the present invention accomplishes its intended objects in providing a buffer for handing off a work piece from one device to another wherein the devices, such as an inkjet printer and a coater/laminator, that may have different processing speeds. The buffer located between the two devices defines a path of travel that preferably is longer than the longest work piece produced by a first device so that the work piece is never in the grips of both devices at the same time. This is especially significant where the work piece is segment comprising the printed output of an inkjet printer and the second or downstream device is a laminator for applying a protective coating to the printed segment. One-way clutches on the drive means for moving the work piece through the buffer accommodates the indexing motion of the inkjet printer and allows such indexing to occur at speeds higher than the transport speed through the buffer. The clutches also allow the downstream device, such as a coater/laminator, to pull a work piece, such as a printed output of an inkjet printer, from the buffer at a speed greater than the transport speed through the buffer.

Conversely, slip clutches in the buffer drive limit the force exerted on the work piece by the buffer drive rollers. This insures that an upstream device can stop the movement of the work piece to perform an operation on one portion of the work piece while another portion of the work piece is in the grip of the buffer.

In a preferred embodiment, the present invention provides a buffer between an ink jet printer and a laminating device wherein the laminator may have a faster processing speed than the printer. The buffer is adapted to receive the printed output of an inkjet printer and deliver the output directly to a laminator wherein the buffer accommodates two processing speeds of the printer and a single operating speed of the laminator.

Having described the invention in detail, what is claimed as new is:

1. A transport buffer for transporting a flexible sheet along a path of travel between an outlet of a first workstation and an inlet of a second workstation, the first workstation intermittently delivering the flexible sheet to the buffer at a first peak speed and at a first average speed in a first mode of operation and continuously delivering the flexible sheet to the buffer at a second speed in a second mode of operation, the second workstation taking up the flexible sheet from the buffer at a third speed, the buffer comprising:

a) a drive roller arranged along the path of travel for engaging and moving the flexible sheet through the buffer, the drive roller being operatively connected to a motor for driving the rollers at a substantially constant drive speed;

b) a first clutch having a predetermined torque limit allowing slippage of the drive roller when the constant drive speed is greater than the speed at which the flexible sheet is delivered to the buffer from the first workstation; and c) a second clutch allowing the drive roller to rotate at a speed faster than the constant drive speed to permit movement of the flexible sheet into the buffer from the first workstation at a speed greater than the constant drive speed.

2. A buffer as in claim 1 wherein the first peak speed and the second speed are faster than the substantially constant drive speed.

3. A buffer as in claim 1 comprising:

a) a drive shaft operatively connected to the drive roller; and b) a drive motor coupled to the drive shaft for driving the shaft at the constant speed.

4. A buffer as in claim 3 wherein the first clutch is connected between the drive motor and the drive shaft.

5. A buffer as in claim 3 wherein second clutch is connected between the drive shaft and the drive roller.

6. A buffer as in claim 1 wherein the flexible sheet has a first maximum length and the path of travel has a length at least equal to the first maximum length.

7. A buffer as in claim 1 wherein the drive rollers engage and pull the sheet from the first workstation and the torque limit of the first clutch is lower than a torque likely to cause a first workstation induced defect on the sheet as a result of the rollers tugging a sheet from the first workstation.

8. A buffer as in claim 1 wherein the third speed is at least as great as the constant drive speed.

9. A buffer as in claim 8 wherein the third speed is greater than the constant drive speed and the second clutch is arranged to allow the drive roller to rotate at a speed faster than the constant drive speed to permit drawing of the flexible sheet into the second workstation from the buffer at the third speed.

10. A transport system including a buffer for transporting a flexible sheet along a path of travel from the outlet of a first workstation to the inlet of a second workstation comprising:

a) means in the first workstation acting to move the sheet from the first workstation at a first average speed and then delivering the sheet from an outlet of the workstation at a second speed;

b) means in the second workstation for moving the sheet through the second workstation at a third speed greater than the first average speed;

c) a buffer arranged for delivering the sheet from the out let to the inlet including a track defining a path of travel from the outlet to the inlet;

d) drive rollers arranged along the path of travel for engaging and moving the sheet through the buffer, the drive rollers being driven at constant speed which is faster than the first average speed;

e) a first clutch allowing slippage of the drive rollers when the sheet is moving from the first workstation at the first average speed to limit the speed of the work piece to the first average speed; and f) a second clutch allowing the over running of the drive roller to permit movement of the sheet into and out of the buffer at a speed greater than the constant speed.

11. A transport system as in claim 10 wherein the sheet has a maximum length and the track defines a path of travel that is at least as long as the maximum length of the sheet.

12. A transport system as in claim 10 comprising:

a) a shaft connected to each drive roller; and b) a drive motor operatively connected to the shaft for driving the shaft at a the constant speed.

13. A transport system as in claim 11 wherein the first clutch operatively connects the drive motor to the shaft.

14. A transport system as in claim 11 wherein the second clutch operatively connects the shaft the drive rollers.

15. A transport system as in claim 11 wherein the constant speed is slower than the second speed.

16. A method of transporting a flexible sheet moving from a first workstation operating at a first average speed and a first peak speed faster than the average speed in a first mode of operation and at a second speed in a second mode of operation, to a second work station operating at a third speed greater than the first average speed comprising:

a) engaging the sheet leaving the first workstation with a rotating driver for moving the sheet along a path of travel at a constant speed from the first workstation to the second workstation;

b) limiting the torque applied by the rotating driver for moving the sheet in the buffer when the constant speed is greater than the speed at which the sheet is moving from the first work station; and c) freeing the rotating driver to rotate at a speed greater than the constant speed to permit movement of the sheet into the buffer at a speed greater than the constant speed.

17. A method as in claim 16 wherein the sheet has a maximum length and the path of travel has a length at least as long as the maximum length.

18. A method as in claim 16 wherein the rotating driver is a shaft driven roller and freeing the roller to rotate faster than the constant speed is accomplished by connecting the shaft to the roller with a one-way clutch that permits the roller to overrun the shaft.

19. A method as in claim 16 wherein the rotating driver includes a motor driven shaft and limiting the torque applied by the rotating driver is accomplished by connecting the motor to the shaft with a slip clutch.

* * * * *